United States Patent [19]

Davis

[11] 4,145,941

[45] Mar. 27, 1979

[54] CULINARY UTENSIL

[76] Inventor: William E. Davis, 762 Lindo La., Port St. Lucie, Fla. 33453

[21] Appl. No.: 735,261

[22] Filed: Oct. 26, 1976

[51] Int. Cl.[2] ..... B26D 7/26

[52] U.S. Cl. ..... 83/167; 83/609; 83/662

[58] Field of Search ..... 83/167, 564, 597, 609, 83/662, 858, 821, 831; 248/37.3; 403/79, 161; 220/85; 74/523, 525

[56] References Cited

U.S. PATENT DOCUMENTS

| | | | |
|---|---|---|---|
| 910,442 | 1/1909 | Wright | 83/597 X |
| 1,317,430 | 9/1919 | Clarke | 83/662 X |
| 1,592,735 | 7/1926 | Johnson | 83/609 X |
| 1,609,365 | 12/1926 | Knott | 83/564 |
| 2,004,858 | 6/1935 | Farabough | 83/167 |
| 2,099,978 | 11/1937 | Hess | 83/167 X |
| 2,346,282 | 4/1944 | Watts | 83/662 |
| 2,481,272 | 9/1949 | Williams | 403/161 |
| 3,139,124 | 6/1964 | Hoff | 83/564 |
| 3,142,905 | 8/1964 | Strasbaugh | 83/662 |
| 3,845,541 | 11/1974 | Ranieri | 83/662 X |

FOREIGN PATENT DOCUMENTS

| | | | |
|---|---|---|---|
| 104157 | 9/1926 | Austria | 83/564 |

*Primary Examiner*—Gary L. Smith
*Attorney, Agent, or Firm*—Dew & Dew

[57] ABSTRACT

A kitchen utensil for the preparation of food and adaptable and easily convertible to numerous uses such as chopping, juicing, dicing, slicing, comminuting, can opening and cracking of nuts. All food processed is collected in a receptacle forming a basic element of the apparatus. Novel means are disclosed for the quick but firm attachment of a chopping blade and can opener, to an operating lever, for use over the receptacle.

18 Claims, 18 Drawing Figures

FIG. 5
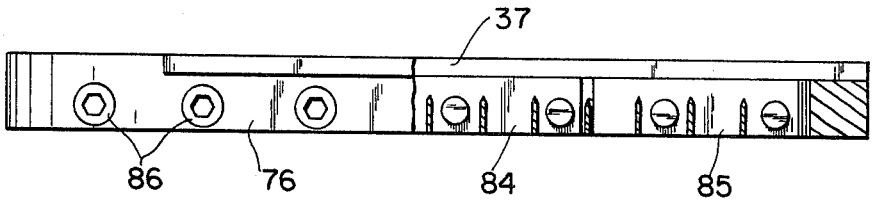
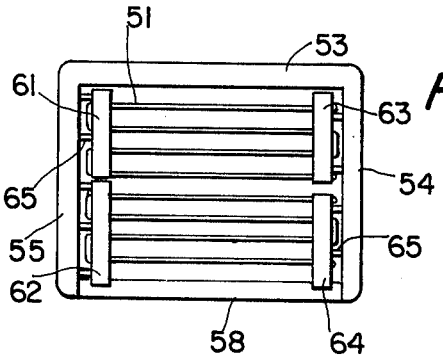
FIG. 18
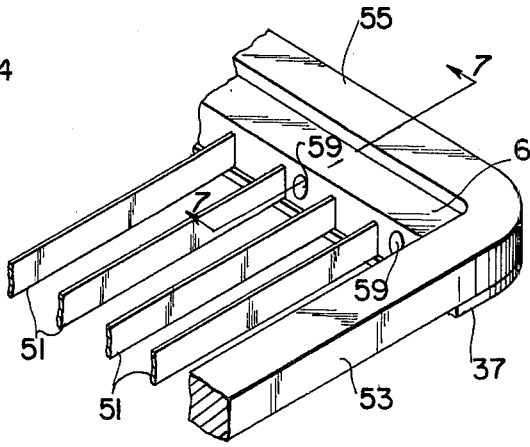
FIG. 6
FIG. 17
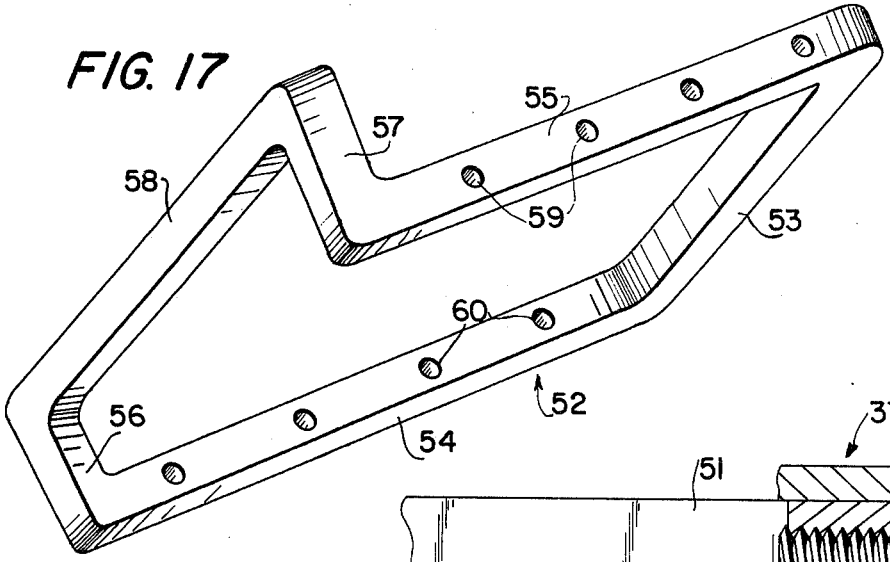
FIG. 16
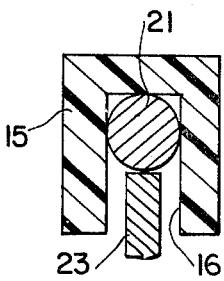
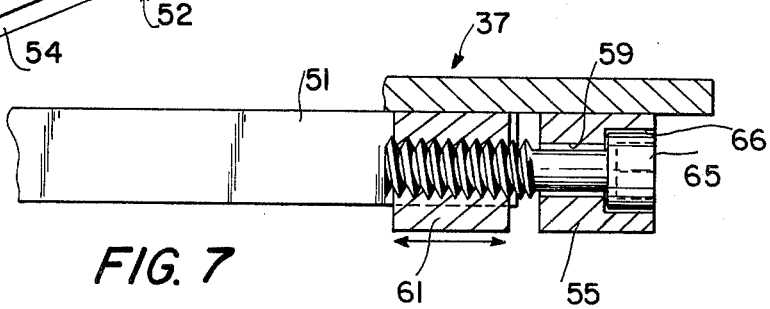
FIG. 7

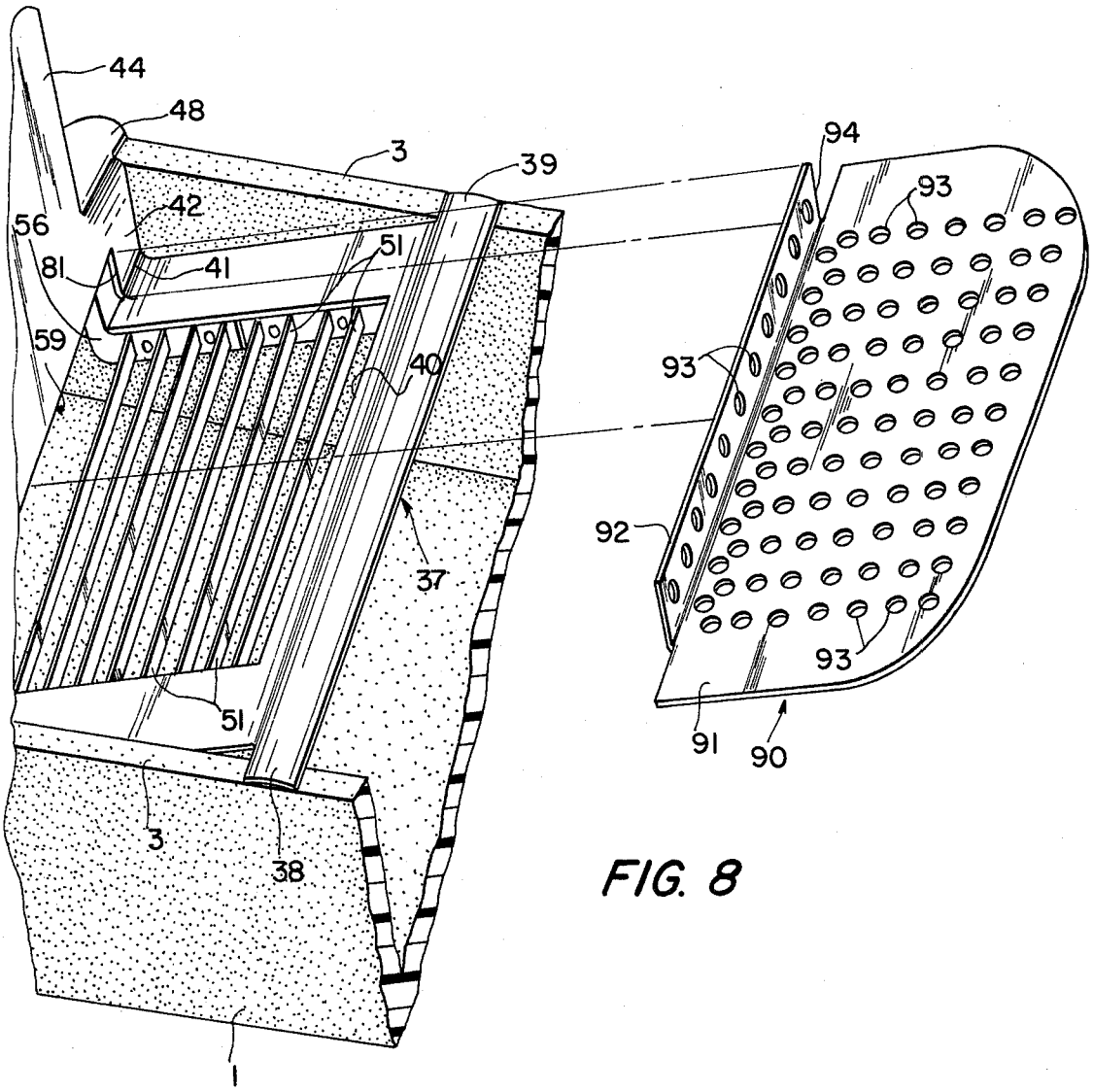
FIG. 8
FIG. 9
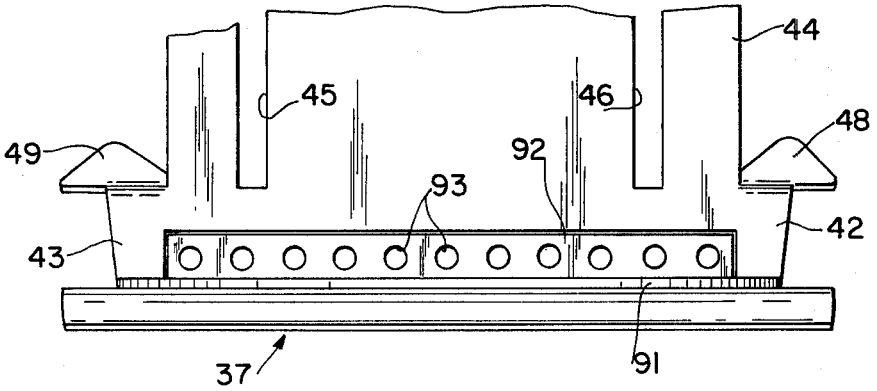

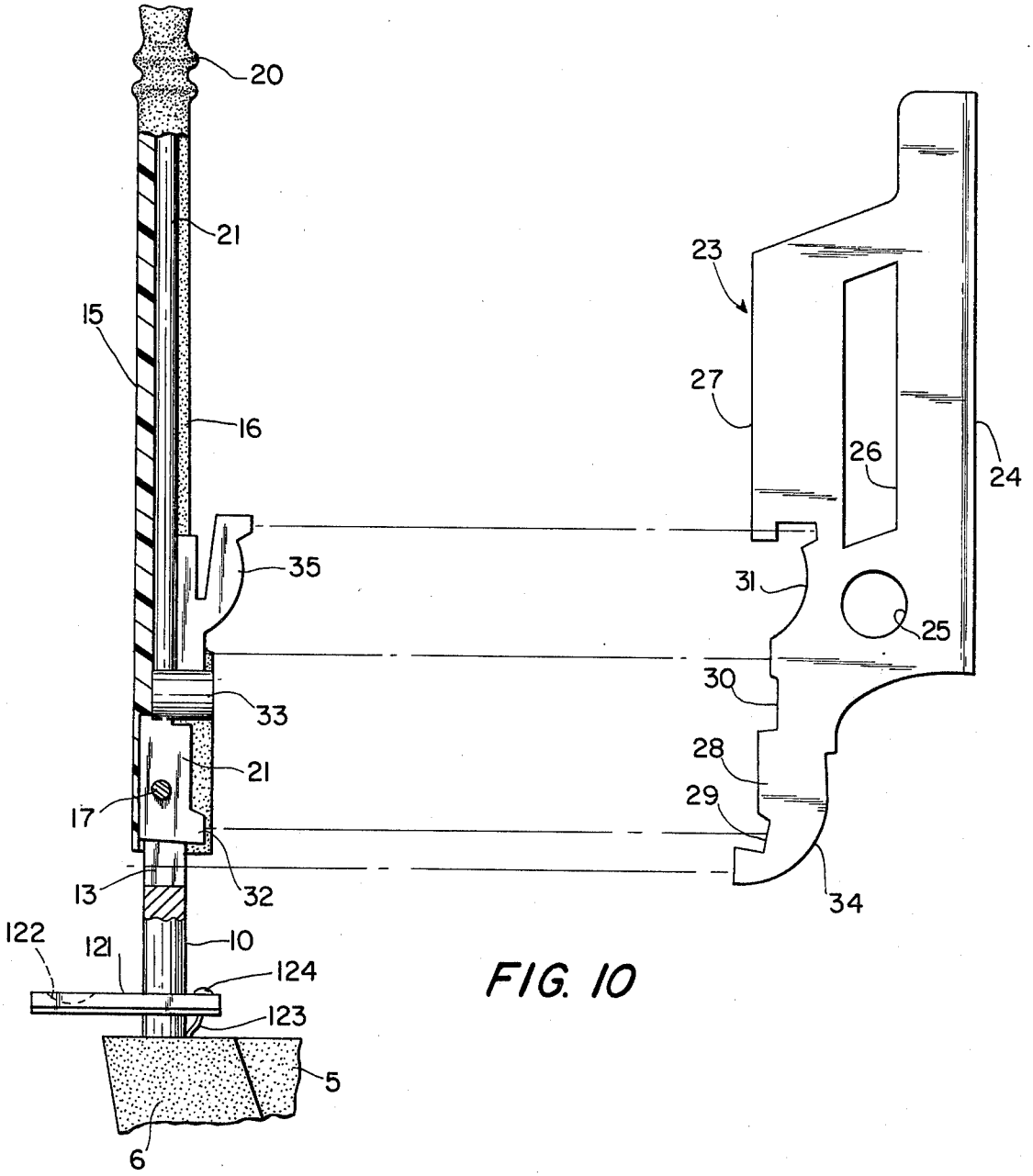
FIG. 10
FIG. 11
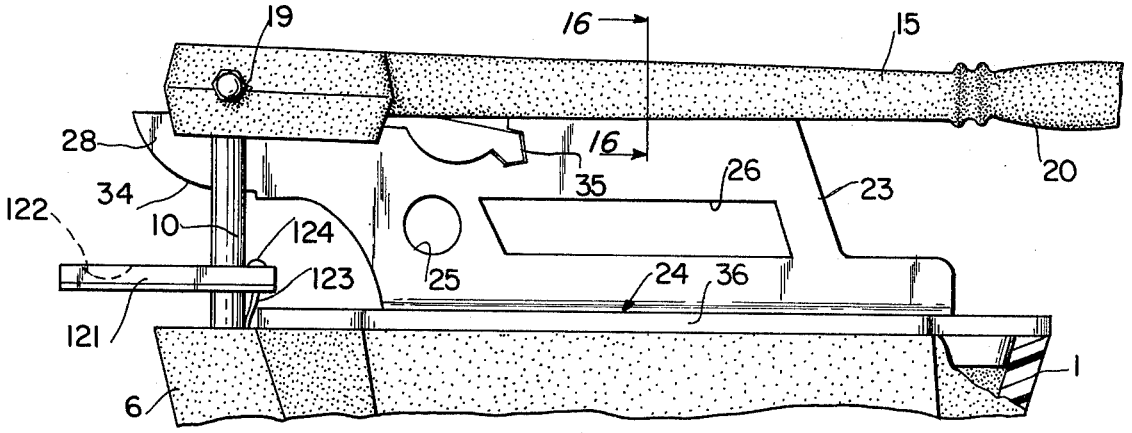

CULINARY UTENSIL

BACKGROUND OF THE INVENTION

The invention relates to a versatile utensil for use in the preparation of food, including meats, fruits and vegetables. The trend to time- and labor-saving devices in the kitchen, of homes, restaurants and fast-food emporiums, is impressive and unmistakable. One reason is the continuous increase in the number of women gainfully employed and who are desirous of spending as little of their spare time as possible in the preparation of meals. Another reason is the general increase in outdoor and social activities as well as the popularity of viewing television. These and other factors augment the urge to both men and women, to decrease to a minimum the time spent in preparation of meals. As an example of the result of this tendency it is of interest to note the present popularity and increase in use of pressure cookers and pans, and microwave ovens by which food can be prepared in a fraction of the time otherwise required by use of open vessels.

The trend above noted is also responsible for the desire to save time presently required by needless searching for, cleaning and storage of a multitude of items commonly used in the kitchen in the preparation of food. Among these are slicers, dicers, choppers, severing devices, juicers, presses, can openers and nut crackers. When such a multitude of items must be separately stored and operated, much time is needlessly consumed in searching for them and cleaning and replacing them after use.

SUMMARY OF THE INVENTION

The present invention solves the aforesaid problems by affording in one compact and efficient group, all of the utensils commonly required for the preparation of food. In a basic combination a single receptacle and permanently attached pressure lever, together with a number of attachments conveniently stored in the receptacle, the housewife whether or not employed outside the home, as well as restaurant and fast-food emporium operators, have available for immediate and rapid use all of the means previously supplied by a wide range of devices ordinarily stored, each in a separate place.

With my invention the assembly ready for use, of the devices commonly needed in the kitchen, is practically instantaneous. All items forming the combined elements thereof, are in a compact package including a receptacle or container which may be taken off a convenient shelf, the needed components quickly assembled and used, and readily washed or cleaned and replaced for subsequent use.

It is therefore the chief object and purpose of the invention to provide in one basic assembly and components therefore, means by which food may be processed and readied for use, in a wide variety of ways as by chopping, severing, slicing, comminuting, dicing, opening of cans, pressing and cracking of nuts.

A further object is to provide a utensil wherein a basic assembly of receptacle with shaft and press lever permanently attached thereto, are adapted to receive and usefully employ attachments for the several uses above identified.

Another object is to provide novel means by which (a) attachments such as a chopping blade or can opener may be easily but rigidly and instantaneously detachably connected to the press lever of the instrument, (b) other attachments for slicing etc., are fixedly but detachably connected with the receptacle and/or the lever, for use individually or in combination with other attachments, (c) cooperation between the press lever and attachments is effected by platens or blocks detachably connected with the lever without the use of tools such as wrenches or screwdrivers.

Yet another object is to provide a utensil as in the preceding paragraphs, wherein all food processed is collected in the recpetacle for facile recovery for complete use and avoidance of waste.

An important object is the provision of a kitchen utensil which is very strong and effective for its intended purposes, long-lived, and which may be manufactured and sold at a price competitive with the total cost of the many separate items it replaces.

Other objects and advantages of the invention will be apparent to those skilled in the art, after a study of the following detailed description in connection with the accompanying drawing.

BRIEF DESCRIPTION OF THE DRAWING

FIG. 5 is a detail side view partly in section, of the slicing attachment as seen in vertical planes through line 5 — 5 of FIG. 2;

FIG. 6 is a detail of one corner of the basic or first slicer, inverted to illustrate the tensioning means for the slicing or cutting strips;

FIG. 7 is a sectional view to a scale enlarged over FIG. 6, showing the mounting of one of the tensioning screws and its connection with one of the mounting bars for the slicing strips, as seen in a vertical plane through line 7 — 7, FIG. 6;

FIG. 8 is a perspective view similar to FIG. 2 but showing the juicer attachment about to be slid into operating position over the base plate of the utensil;

FIG. 9 is a detail view of the base plate with juicer attachment in position thereon;

FIG. 10 is a side elevation partly in section, showing the operating lever in vertical position and attached to its shaft, with chopping blade detached to illustrate how it is releasably connected to the lever;

FIG. 11 is a side elevation partly in section, showing the chopping blade coupled to the operating lever and resting with its cutting edge on a board specially shaped for the base receptacle;

FIG. 16 is a detail section in a plane identified by line 16 — 16, FIG. 11;

FIG. 17 is a perspective view from below and to one side, of the frame for supporting and tensioning the cutting or slicing strips of the base plate as in FIG. 1; and FIG. 18 is a bottom plan to a reduced scale, showing in detail the tensioning means for the slicing strips or ribbons of the base plate.

DESCRIPTION OF THE PREFERRED EMBODIMENTS

Figures 1, 14, 15:
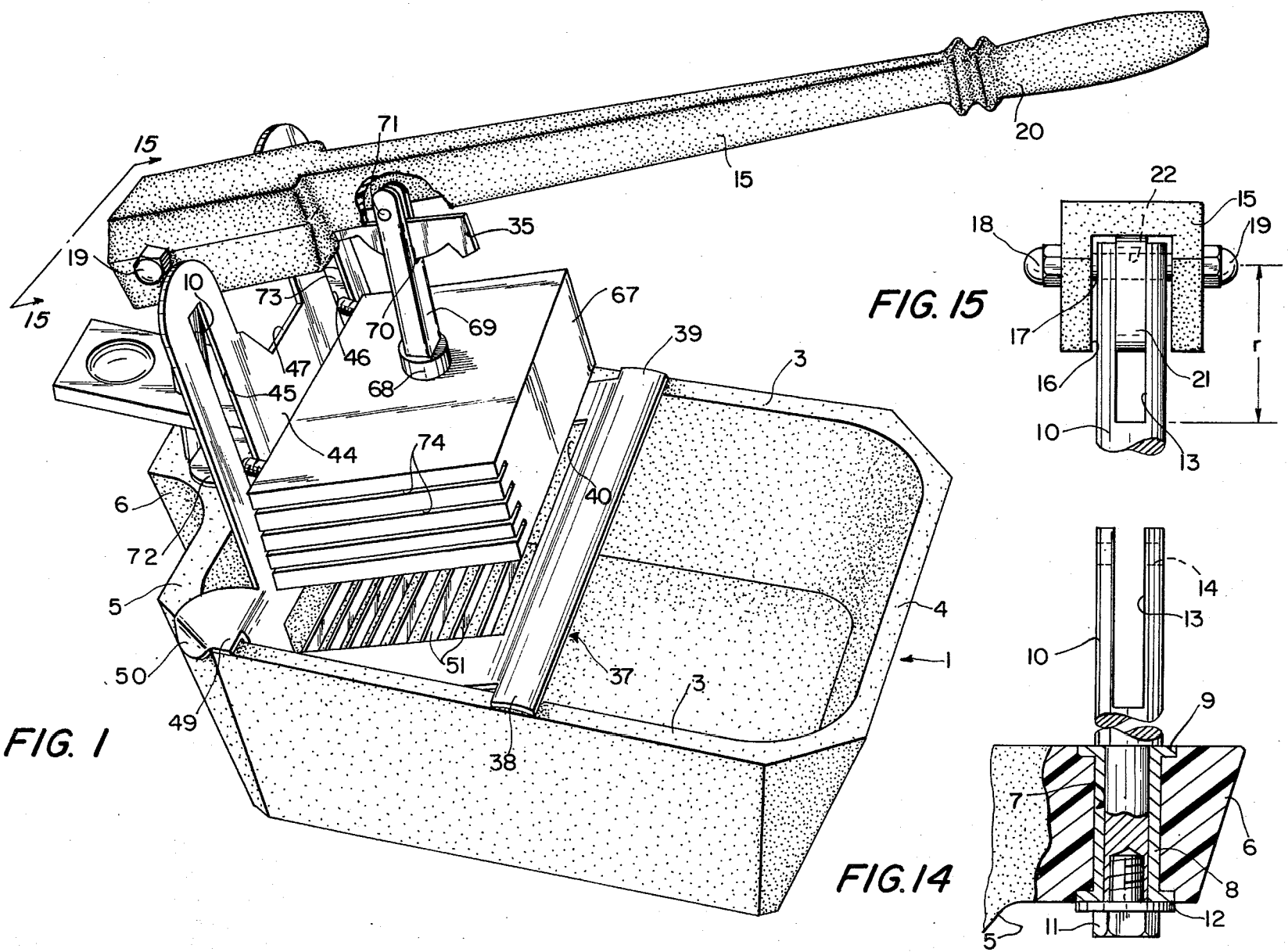
FIG. 1 is a perspective view of the utensil assembled for use in slicing.
FIG. 14 is a detail showing in section and to about full scale, the swivel mounting for the lower end of the press lever supporting shaft.
FIG. 15 is an end view of the lever showing its pivotal attachment to the top end of the support shaft.

Referring particularly to FIG. 1, a one-piece receptacle or container 1 of metal or hard strong plastic comprises a imperforate bottom 2, side walls 3 and end walls 4 and 5 the latter being formed with an integral projection 6 extending rearwardly from its top central portion. From FIG. 14 it is noted that this projection is vertically bored at 7. A metal sleeve or grommet 8 is fixed in the bore, as by a press fit therein and/or ends such as 9 which may be flanged after the sleeve is emplaced.

A metal shaft or column 10 has its lower end reduced in diameter to form an annular shoulder. The reduced end is sized for a smooth fit in sleeve 8 so that the shaft is journaled therein for free accurate rotation about a vertical axis. The lower end of the shaft is axially drilled and tapped to receive a machine screw 11 which, with washer 12 releasably secures shaft 10 in position with its shoulder bearing on the top end of sleeve 8. FIG. 14 also shows that the top end of the shaft is vertically and centrally slotted as at 13, and drilled diametrically at 14 to form a pivot bearing extending across and normal to the slot, it being noted that upon FIG. 14 shaft 10 is turned about 90° from its position of normal use.

FIGS. 1 and 15 show a lever 15 having its lower surface channeled as at 16, anoting also FIG. 10. At its rearward end the lever is transversely bored to accomodate a pivot 17 which also traverses hole 14 in shaft 10 and thus mounts the lever for turning about a normally horizontal axis. The lever is thus universally pivotable about mutually normal vertical and horizontal axes. An ornamental head 18 on one end of pivot 17 and nut 19 threaded thereon hold the pivot in place. As seen at 20, FIG. 1, the distal end of the lever is shaped to provide a handle.

As shown upon FIGS. 10 and 16 channel 16 extends substantially the entire length of lever 15. At the rearward or proximal end thereof a specially-shaped locking plate 21, subsequently described in detail, is fixed within the channel, centrally thereof as shown at FIG. 15. Since pivot 17 passes with a smooth fit through a bore 22 in the plate, the latter is firmly held in the channel at the rearward end thereof. The forward end of plate or element 21 is reduced to the shape of a rod which may be circular or rectangular in transverse section and which, as subsequently explained, forms an abutment for the chopping blade 23 and when in use extends linearly of and along the lever, noting FIG. 16 in particular. The parts described in the foregoing paragraphs form a basic utensil combination which is adaptable to a number of uses.

Chopping blade 23 is shown in detail upon FIGS. 10 and 11, from which it is seen to be a one-piece item of steel, preferably stainless, with a lower essentially straight cutting edge 24. Lightening holes 25 and 26 are formed in and through the blade. The forward upper edge of the blade is straight, as indicated at 27 and which when in use linearly abuts the rod-like forward part of element 21. See FIGS. 10 and 16. The rearward end of the blade is formed with a rearward projection 28, having therein notches 29, 30 and 31. Inspection of FIG. 10 shows that when the blade is fixed to the lever, notch 29 fits about and receives a lug 32 integrally formed on element 21. Notch 30 is formed to accomodate and fit about a pressure element 33 integrally attached as by welding, to element 21 and used when the utensil is employed for cracking nuts in the manner subsequently explained.

Projection 28 is also formed with an arcuate lower edge 34. The radius of this edge is closely equal to or slightly less than the radial distance from the axis of pivota 17 to the lower end of slot 13 in shaft 10, as indicated at "*r*," FIG. 15. The projection is also constructed and proportioned so that when lever 15 is in its erect or substantially vertical position blade 23 may be easily emplaced by moving it to the left from the position of FIG. 10, into slightly offset contiguous relation with element 21, until notch 29 is in registration with lug 32 and edge 27 is within channel 16. At this the specially-shaped notch 31, FIG. 10, registers with projection 35 which is specially shaped for use in pressing, as subsequently explained. Then the blade may be moved slightly in a direction normal to its plane so that its upper edge 27 linearly contacts that portion of element 21 within channel 16; and when lever 15 is pivoted downwardly about pivot 17, projection 28 rides into slot 13 of shaft 10, with its arcuate edge 34 in smooth sliding contact with the end of the slot. This movement positively locks the blade to the lever for operation in chopping, because it cannot move sideways that is, in a direction normal to its plane, due to its fit in slot 13, and it cannot drop downwardly because of the interfit between projection 35 and notch 31. This is clear from inspection of FIG. 10.

At 36, FIG. 11, is indicated a chopping board which may be of hard wood. The board has a flat upper surface and a periphery corresponding in size and shape to the top edge of the walls of receptacle 1. Its lower edge is rabbetted to a shape fitting smoothly within the receptacle so that when in place it cannot move or shift laterally. Thus when blade 23 is fixed to lever 15 and board 36 is emplaced as previously described, foodstuffs such as fruits, vegetables and meats may be placed upon the board and sliced or comminuted, as desired, by pivotal movement of the lever about the axis of pivot 17 with interspersed swinging of the lever about the axis of shaft 10. Release of chopping blade 23 for cleaning and/or conversion of the invention to other uses may be readily effected merely by raising the lever to about its vertical position as in FIG. 10. This moves arcuate edge 34 clear of slot 13 in shaft 10 and enables the blade to be shifted slightly transversely of its plane, thus moving notch 31 free of projection 35.

The invention is easily adapted to use as a press for producing fruit and vegetable juices, for slicing and dicing fruits and vegetables and for numerous other uses as generally shown upon FIG. 1. A base plate of heavy gage sheet metal is generally indicated at 37, FIG. 8, and is provided with flanges 38, 39 at its front corners and which when the plate is emplaced, rest upon the top edges of side walls 3.

The central portion of plate 37 is cut out to form a rectangular opening 40, open at the back. The side portions of the plate at the back, right and left, are bent upwardly at about 90°. One of these bends is indicated at 41, FIG. 8. The upward extensions 42, 43 (FIG. 9) thus formed are integrally united with and by the lower portion of a riser 44 and which as shown upon FIG. 1, has essentially vertical laterally-spaced slots 45, 46 with an interposed notch 47 to enable downward pivoting of lever 15. Ears 48, 49, right and left FIG. 9, are also integral with plate 37 so that when it is in operating location the ears rest upon respective back corner edges of reseptacle 1. As is clear from inspection of FIG. 1 the ears have integral downwardly-turned tabs as at 50 for ear 49, and which fit down about the beveled corners of the receptacle. Thus when emplaced, plate 37 is fixed against lateral movement with respect to the receptacle and can only be removed by upward translation. Further, in the emplaced position, riser 44 and its slots 45, 46 are fixed with the receptacle and form guide means for the press platen subsequently described. When in operating position the plate slopes downwardly and rearwardly into the receptacle 1, as best shown upon FIG. 8.

Opening 40 in base plate 37 is traversed by parallel cutting or slicing bars 51 of rust-proof metal and shown upon FIGS. 1 and 8 as extending transversely of the receptacle, when emplaced, in closely-spaced relation. The bars are tensioned and thin so that they present coplanar upper cutting edges. In addition these bars or ribbons may be ¼ inch or more in width, that is, in the normally vertical direction so that they are powerful in resisting downward forces exerted upon them.

FIG. 17 shows detached and in perspective from below, a reinforcing and stiffening bar or frame 52 and which in the assembled instrument is welded or otherwise rigidly secured to the under side of base plate 37. As shown, the frame is a continuous metal bar square in cross section and about ⅜ inch on a side. Its forward transverse run 53 extends along and in registration with the forward edge of opening 40. Runs 54, 55, both normal to run 53 extend rearwardly along and outwardly spaced from the inner side edges of opening 40. Riser portions 56, 57 of the frame extend behind and in contact with the right and left upward extensions of plate 37 formed by bends 41 therein, noting FIG. 8 in particular. The rearward transverse run 58 of the frame has its lower edge about flush with the lower edge 59 of riser 44. Since the frame is welded or otherwise rigidly attached to plate 37, continuously or at closely-spaced points along its length, the plate is extremely strong and rigid in all directions.

FIG. 17 also shows that side runs 54, 55 of frame 52 are each drilled with a number of holes such as 59, 60, four such holes being shown in each run in the model selected for illustration. The holes are preferably uniformly spaced in each side run but for reasons which will later appear, each hole is offset in the direction along its run, with respect to the corresponding hole at the opposite side. FIG. 18 shows four relatively short bars 61, 62, 63, 64 between which the metal slicing strips or ribbons 51 extend. The bars are of the same transverse dimensions as the material of frame 52 and are transversely slotted at locations uniformly spaed therealong, from their top surfaces downwardly. Each slot has a depth equal to the width of strips or ribbons 51 and, of course, stops a material distance short of the lower surface of the bars. In the model shown there are two slicing ribbons 51. Beginning at the top right, FIG. 18, the first ribbon is headed over to prevent it from passing through its slot in bar 63. It then passes to the left through the first slot in bar 61, then about the bar and through the second slot therein, back to bar 53, through the second slot in bar 63, back to bar 61, through the second slot therein, back to bar 61, through the third slot therein and around the end of this bar to bar 63 and through the fourth slot, where its other end is headed over. The second ribbon 51 is passed or threaded in the same way through and about the slots in bars 62 and 64, as clearly appears from FIG. 18. The eight passes of the two ribbons thus form equally-spaced parallel cutting or slicing edges.

Each bar 61 through 64 is held to its side run of frame 52, by a pair of Allen-head machine screws. FIG. 7 illustrates one such screw 65 as having its head seated within a counterbore 66 of one bore 59 of side run 55. The threaded end of the screw engages a tapped hole in short bar 61. This figure also shows that each of the four short bars is in sliding contact with the under surface of the sides of plate 37.

In a way clear from inspection of FIGS. 7 and 18, the pair of screws threaded into each short bar 61 through 64, may be turned to draw it toward the corresponding side run 54 or 55, as the case maybe, to thereby tension ribbons 51 to any desired extent. Thus the upper edges of these ribbons collectively define a very rigid and efficient cutting or slicing plane surface when fruit, vegetables or other foodstuffs are forced downwardly over and through them, into receptacle 1.

Force to effect slicing, comminuting and juicing is exerted by lever 15 acting upon a platen or block 67, FIG. 1, and which may be of hard wood. An internally threaded metal sleeve 68 is fixedly embedded in the center of the top surface of the block, to accept the threaded lower end of a plunger 69, shown as square in cross section. The upper end of the plunger is axially slotted as at 70. A pin 71 has a press fit in a bore in the plunger, traversing the slot near its upper end. The construction and dimensions are such that the slot receives with a smooth fit between its lower end and pin 71, the projection 35 of plate or element 21, previously described. Thus when projection 35 and plunger 69 are releasably coupled as shown upon FIG. 1, operation of the lever effects vertical movement or reciprocation of block 67 toward and from the slicing surface conjointly defined by the top edges of ribbons 51.

The two slots 45, 46 in riser portion 44 of base plate 37 have been previously described. FIG. 1 shows that block 67 has first and second screws 72, 73 threaded into its rearward surface near the top edge thereof. The guide screws are spaced the same as the slots so that each may pass freely through its respective slot. Each screw is formed at its free end with an enlarged flat head whose plane lies in and along the axis of the screw. The screws are preferably threaded into metal sleeves fixedly embedded in the block and so located that the axis of each screw when in place, extends upwardlly and rearwardly at an acute angle of 10 to 15 degreees with respect to the top surface of the block. By turning the screws so that the head of each is parallel to the slots, they easily pass therethrough. Then when they are turned 90° their flat ends extend transversely of the slots and thus act to retain the block to riser 44, for guided reciprocation in parallel with the slots and toward and from plate 37, by and in response to vertical pivoting of lever 15. By raising the block, inserting an article of foodstuff between it and ribbons 51, forcing the lever downwardly effects a very neat and efficient slicing.

Figure 2:
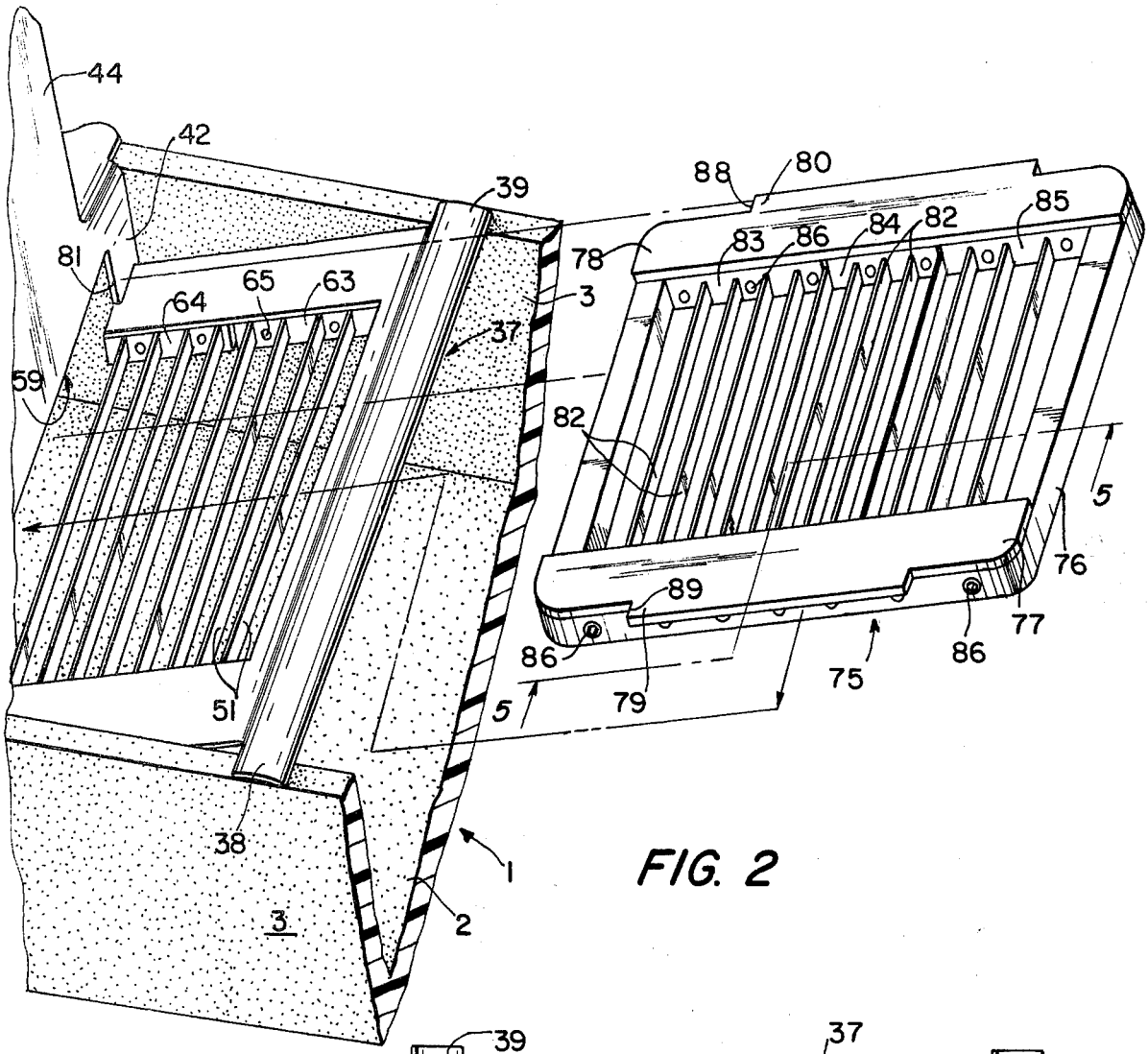
FIG. 2 is a broken perspective view showing part of the receptacle of FIG. 1, with the first slicer in position and a second slicing or dicing attachment about to be slid into operating position over the first.

If desired the lower surface of block 67 may be formed with shallow parallel slots spaced like ribbons 51 and located so that when the block is forced downwardly the ribbons enter the slots with a smooth fit to completely shear off the material being sliced. The slots just described are not shown. But FIG. 1 shows a number of them at 74 extending across one end of the block. With such a construction the end of the block opposite the slots has a threaded sleeve like 68, FIG. 1, embedded centrally in its surface. The threads of the sleeve are sized to accept the threaded lower end of a plunger like 69. This construction is very useful where smaller articles such as radishes or boiled eggs are to be sliced. While screws 72, 73 previously described, are convenient and useful in guiding block 67 in vertical movement, they are not absolutely necessary at all times because the block may be guided by hand.

Where dicing or fine division of foodstuff is desired the attachment indicated generally at 75, FIG. 2, is very useful. This comprises a one-piece rectangular frame 76 of metal, with end plates 77, 78 shaped alike as shown upon the figure and welded to the respective end runs of the frame. Each end plate has a coplanar extension such as 79, 80. The dimensions of attachment 75 are such that it may rest atop base plate 37 with a smooth fit beneath edge 59 of riser portion 44, and between the two vertical inside edges thereof such as 81, FIG. 8. This position is illustrated upon FIG. 4 wherein extension 79 is shown as abutting the inside surface of rear wall 5 of receptacle 1. The cutting or splicing strips 82 of frame 76 are mounted and tensioned by essentially the same means as have been described previously in connection with FIG. 18. It is therefore deemed not necessary to repeat the description. Suffice it to say that parallel ribbon strips 82 are shown as twelve in number, spaced the same as ribbons 51. The short slotted bars like 61, 62, FIG. 18, are three in number along each side of frame 76. These are identified at 83, 84, 85, each being slotted from its lower side upwardly, to accomodate with a close fit a respective number of passes of ribbons 82. The three bars, not shown, at the other side are similarly arranged. All of these bars are in smooth sliding contact with the under side surfaces of end plates 77 and 78. A total of three lengths of ribbon are used, one for each pair of opposed bars. As in FIGS. 7 and 18 the runs of ribbons 82 are tensioned by Allen-head screws 86, FIGS. 2 and 5, there being at least two for each bar. The inner end of each screw is threaded into its bar in the way indicated upon FIG. 7 for items 61 and 65. As in the construction of FIG. 18, turning of the screws effects high tension in the thin metal ribbons 82 so that their coplanar upper edges form efficient and effective cutting or slicing means.

Figure 4:
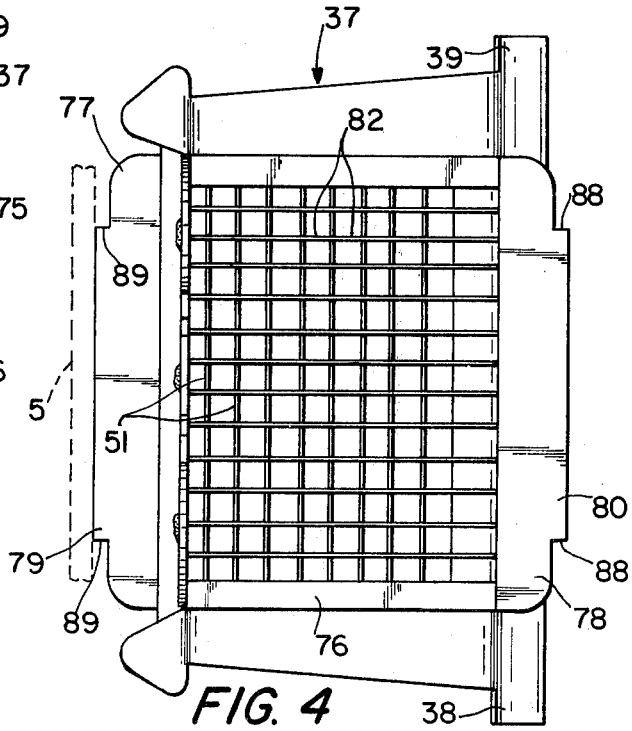
FIG. 4 is a plan view corresponding to FIG. 3 but with the second attachment at 90° to its position of FIG. 3, as where dicing of foodstuff is to be effected.

FIG. 4 shows the arrangement when attachment 75 is used with its ribbons normal to those of base 37. In this position the two sets of ribbons define means by which vegetables or fruit may be diced or cut into relatively fine strips when force is applied by operation of lever 15, it being noted that the upper edges of ribbons 51 are essentially in contact with the under edges of ribbons 82 at their crossover points.

Figure 3:
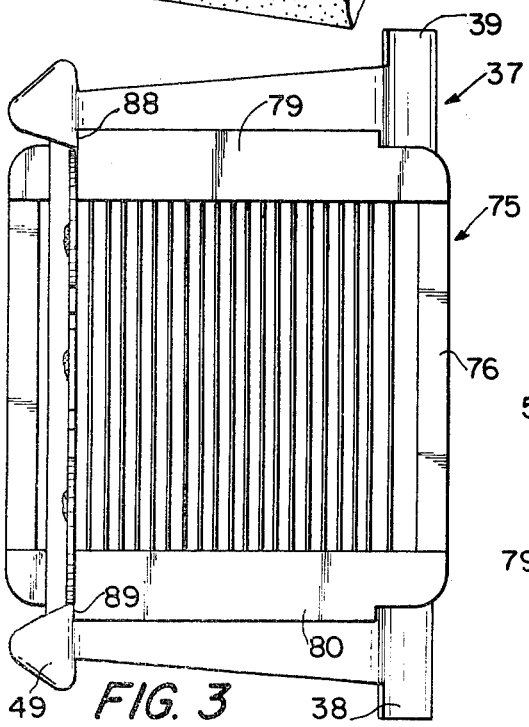
FIG. 3 is a plan view showing the second slicer attachment in operating position over the first one.

FIG. 3 shows the position of attachment 75 when operatively located over base 37. with its cutting ribbons 82 parallel to ribbons 51. This position is determined by the abutment of shoulders such as 88, 89, FIG. 3, with the riser portions such as 81, FIG. 2, of the base, it being noted that frame 76 is dimensioned to slide freely below edge 59. The construction and dimensions are such that in the postion and relations of FIG. 3 each pass of ribbons 82 is located in a vertical plane midway between two contiguous passes of ribbons 51 so that food may thus be sliced into layers having a thickness about one-half of those produced when using plate 37 alone.

As indicated generally at 90, FIG. 8 shows a very useful attachment for the production of juice and the like. This comprises a heavy metal plate generally rectangular in shape and rounded at its front corners. The rear edge is upturned to form a flange 92. Perforations 93 are disposed as shown, in regularly-spaced or geometrical relation over the main area of the plate and the flange. The plate is dimensioned to fit over and in surface contact with base 37. The distance between end edges 94 of flange 92 is slightly less than that between riser portions 42, 43, FIG. 9, that is, between the inside edges thereof. The vertical dimension of the flange is slightly less than the corresponding dimension from edge 59 downwardly to the plane defined by the top surface of the side portions of base 37. Since flange 92 is rearwardly offset from plate 91, it fits smoothly within the slot below edge 59 and thus the attachment is firmly but releasably fixed in position against lateral movement on and with respect to plate 37. Thus when in operating position the flange fits and closes the opening otherwise present from edge 59 downwardly. This feature assures that juice flowing rearwardly is strained by passing through holes 93 in the flange.

Figure 12:
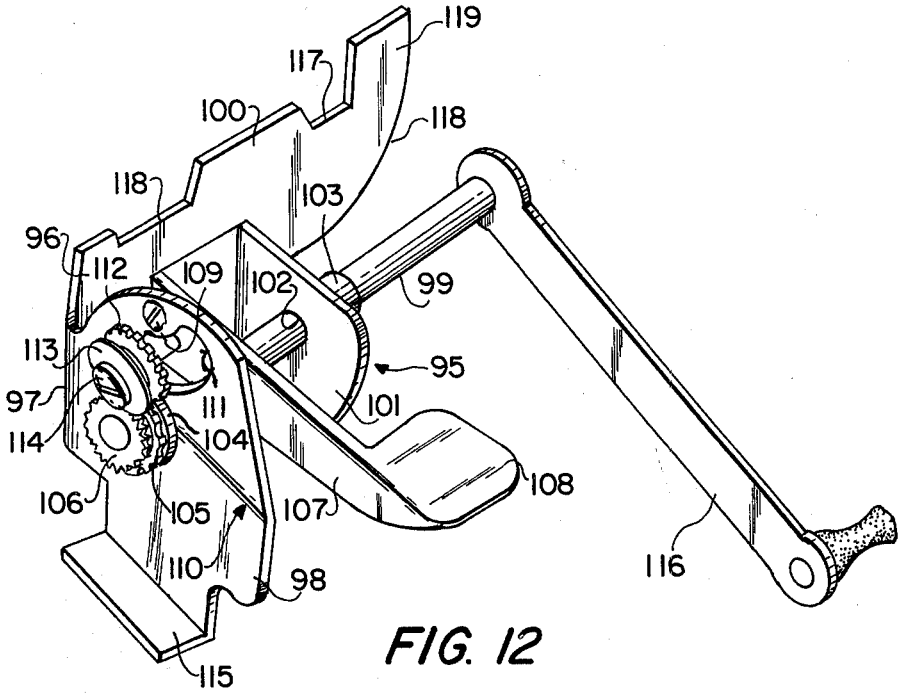
FIG. 12 shows in perspective a can opener with a supporting bracket for attachment to the shaft or column of the base receptacle.
Figure 13:
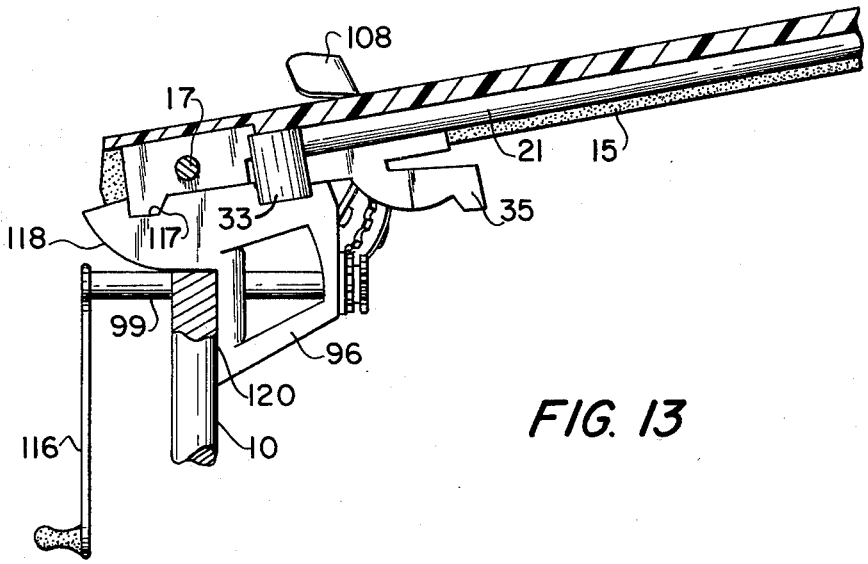
FIG. 13 is a view partly in section and to a scale reduced from that of FIG. 12, showing how the can opener is firmly but releasably connected with the shaft of the base receptacle.

Referring to FIGS. 12 and 13, a can opener of novel construction is indicated generally at 95. The base or supporting bracket 96 comprises an initially flat heavy metal plate bent at right angle along line 97, FIG. 12, to define a first arm 98 drilled to journal the inner end of shaft 99. The second arm 100 is sheared to define a tab 101 parallel with and spaced from arm 98 and pierced at 102 to form a second bearing for the shaft. A first collar 103 fixed to the shaft bears against tab 101 and prevents axial motion of the shaft in one direction. A handle 116 is affixed to the outer or distal end of the shaft. The inner end of the shaft has a collar 104 fixed thereto. This abuts the end surface of arm 98 and prevents axial motion of the shaft in the other direction. The end of the shaft protruding from first arm 98 has a gear 105 fixed thereto. A crimping wheel 106 of about the same diameter as the gear, is also fixed to the shaft slightly axially spaced from the gear.

Cutter control lever 107 has an offset thumb tab 108 and is pivoted to arm 98 by a machine screw 109 secured by a nut, not shown, on its inner end. Also to be noted is the fact that the upper portion of arm 98 is bent outwardly along line 110 at an angle of about 20° so that the axes of shaft 99 and screw 114 are vertically coplanar but are inclined relatively, at a corresponding angle. A slot 111 in arm 98 is arcuate about the axis of screw 109. Lever 107 is of bellcrank form with its shorter arm at about right angle to the arm shown upon FIG. 12. The distal end of the shorter arm has a stub shaft fixed therein and on which is journaled a gear 112 of larger pitch diameter and number of teeth than gear 105. The ratio may be about 2:3. That is, when the gears intermesh, 105 makes about two revolutions for three for gear 112. The exact ratio is not critical but may be varied within small limits.

Cutting wheel 113 having the usual continuous sharp circular edge is fixed with gear 112 as, for instance, being integral with the same sleeve, journaled on the aforesaid stub shaft. The free end of the stub is axially drilled and tapped to accept a screw 114 having an enlarged slotted head which maintains the gear and wheel against axial movement along the stub shaft. The lower end of arm 98 has an integral outward flange 115 which engages the side walls of a can being opened. In the cutting position the stub contacts one end of slot 111. This is the position shown upon FIG. 12.

Upward force on tab 108 pivots the stub, gear 112 and wheel 113 upwardly out of the operating position with respect to the axis of shaft 99. This limiting position is determined by abutment of the stub with the other end of the slot. In this position of the parts a can to be opened is located with its rim between wheel 106 and gear 105. Then when lever 107 is forced downwardly to cutting position, wheel 113 pierces the top of the can and gears 105 and 112 intermesh. Then the handle may be turned while crimping wheel 106 engages beneath the rim of the can to turn the same, while cutting wheel 113 is positively rotated at somewhat greater linear speed to sever the metal of the can's top.

FIG. 12 shows second arm 100 of bracket 96 as having a shape similar to that of the rearward part of the upper edge of chopping blade 23, noting FIG. 10 in particular. Thus the bracket is formed with a notch 117 corresponding to notch 29 of the chopping blade, and a second notch 118 to accomodate press element 33, FIG. 10. The arcuate edge 118 is curved as concentric with the axis of pivot 17 when the opener is emplaced as shown upon FIG. 13.

Thus in a way which will be clear from the foregoing description, and inspection of FIG. 13, the can opener may be rigidly and detachably fixed to shaft 10, by raining lever 15 until it is at about 45° with respect to the horizontal. Then the end 119 of arm 100 may be inserted into slot 13 of shaft 10, with arcuate edge 118 in contact with the end of the slot, and notch 117 fitting about plug 32. When lever 15 is then pivoted to about the horizontal, a straight edge 120, FIG. 13, of bracket 96 linearly contacts along shaft 10. The opener is then rigidly fixed to the shaft. In this position the opener can be swung with the shaft, about the axis of the latter, to a position over receptacle 1 so that any juice or liquid escaping from the opened can falls into the receptacle and may be recovered. In this position handle 116 is disposed in laterally offset relation with respect to the receptacle and is thus free of any interference therefrom. While opener lever 116 is being rotated with one hand, press lever 15 may be gripped with the other to thus firmly maintain the instrument against undesired swinging with and about the axis of shaft 10.

FIGS. 10 and 11 show an anvil 121 of heavy gage metal, having a hole loosely fitting about shaft 10 so that it may be freely adjusted upwardly to any extent but locks to the shaft in response to a downward force thereon offset from the axis of the shaft. A circular depression 122 in the top surface of the anvil has its center offset from the axis of the shaft by the same distance therefrom as the center of metal pressure element 33 previously described as fixed with the under side of lever 15. Thus the invention may be used for cracking nuts when all attachments are removed from the receptacle and/or detached from lever 15, by adjusting anvil 121 vertically to accomodate the average diameter of the particular nuts to be cracked, and swinging it over receptacle 1. Then when lever 15 is pivoted downwardly a nut resting in depression 122 may be cracked by force thereon exerted between element 33 and the anvil. A leaf spring 123 is held on the anvil, as by machine screw 124, so that its lower end frictionally and resiliently engages the shaft, thus releasably holding the anvil in any position of vertical adjustment. The end of the spring also prevents the anvil from descending too far along the shaft, by engagement with the upper end of sleeve 8, noting FIG. 14. When swung to a position with depression 122 directed away from the receptacle the anvil is clear of and does not interfere with use of any of the other attachments previously described.

The operation and use of the invention for numerous purposes will be clear from the foregoing description. It can be rapidly easily and sequentially converted to use in chopping, cutting, severing, slicing, dicing, comminuting, juicing, can opening and cracking. The user has available the selection of a plurality of thicknesses into which the food is sliced. All solids and liquids are collected directly into the receptacle and thus completely recovered for use thus eliminating waste of food. All metal parts are preferably of stainless steel; and all parts or attachments are freely separable from the receptacle or from the shaft for cleaning and drying.

While I have disclosed herein the embodiments presently preferred by me, the disclosure is to be taken in an illustrative rather than a limiting sense. For numerous changes in shape, constructions, relations of the parts, substitutions of equivalents and modifications of structure and mode of operation, will readily occur to those skilled in the art, after a study of the forgoing specification.

I claim:

1. A utensil comprising an open-top imperforate receptacle having a bottom and side and end walls upstanding therefrom, there being a projection extending externally from and integral with one said wall and having a vertical smooth bore therethrough, a normally vertical shaft journaled in said bore for rotation about its longitudinal axis and having a vertically and diametrically extending slot in its upper end, a lever having a channel extending longitudinally in and along its lower surface and essentially throughout the length of said lever, a bearing plate fixed with said lever within the proximal end of said channel and fitting said slot throughout its length, and a normally horizontal pivot extending through aligned holes in the proximal end of said lever and said plate and across the slot in said shaft, to thereby pivot said lever for universal angular movement over said receptacle.

2. The utensil of claim 1, said projection extending centrally from the top portion of said end wall.

3. The utensil of claim 1, a chopping blade having a straight upper edge portion receivable in the channel in said lever, there being a first notch in said edge portion, constructed and arranged for an interfit with a downward extension of said bearing plate, the rearward end of said blade having a rearward projection defining a lower edge arcuate about the axis of said pivot as a center, when said notch and extension are interfitting, said arcuate edge moving into and slidable contacting the end of said slot in said shaft, as said lever is pivoted downwardly about said axis, to thereby positively and releasably hold said blade to said lever with its straight upper edge portion within said channel and in contact with said lever.

4. The utensil of claim 3, and a chopping board correspondingly shaped with the top edge of said receptacle for support thereon, said board being rabbetted at the lower border of its periphery for a smooth fit downwardly within the confines of said walls.

5. The utensil of claim 3, a projection fixedly connected with said lever, forwardly of said extension and extending downwardly and longitudinally in the median plane of said lever, there being a second notch in the upper edge of said blade, forwardly of said first notch and having a smooth fit with said projection to thereby prevent movement of said blade longitudinally with respect to and when operatively associated with said lever.

6. The utensil of claim 4, said blade having a lower cutting edge contacting said emplaced board when said lever and attached blade are in essentially horizontal position.

7. The utensil of claim 6, said cutting edge being straight and linearly contacting said emplaced board in said horizontal position.

8. The utensil of claim 1, a rectangular base plate having a central rectangular opening and tabs at its four corners resting on the top edge of the wall of said receptacle and supporting said plate thereover beneath said lever, a metal ribbon, tensioning means rigidly securing said ribbon to the sides of said plate, therebeneath, to form a plurality of spaced passes across the opening in said plate, the greater transverse dimension of said ribbon being normal to the plane of said plate.

9. The utensil of claim 8, said tensioning means comprising a rigid frame fixedly secured to and beneath said plate to extend along the external periphery of the sides thereof, a plurality of bars each slotted transversely at locations longitudinally spaced therealong and in guided contact with a respective side of said plate and inwardly of the side runs of said frame, screws journaled in each said side run, spaced therealong and threaded into a respective one of said bars, said ribbon passing through each slot in succession, back and forth from one side of said opening to the other, for tensioning by and in response to turning of said screws.

10. The utensil of claim 8, a press block having a plane lower surface, a plunger rod, meand detachably connecting the ends, lower and upper, of said plunger rod to said block and the projection of said lever, respectively, to thereby mount said block for translation toward and from the plane surface defined by the upper edges of said ribbon, by and in response to pivoting of said lever about its horizontal axis.

11. The utensil of claim 10, all passes of said ribbon being parallel and equally spaced, there being parallel grooves in and across a plane surface of said block, spaced the same as said passes of said ribbon, and means fixed with the surface of said block, opposite the grooves therein, for detachably connecting thereto the lower end of said plunger rod.

12. The utensil of claim 10, said detachable connecting means comprising a slot transversely in and across the upper end of said rod, to receive and fit about said projection, a threaded lower end of said rod, and an internally threaded metal sleeve fixed in and centrally of the top surface of said block for reception of the threaded end of said rod.

13. The utensil of claim 10, said base plate being upturned at about 90° at its rear portion, along a line transversely of said receptacle, to form a plane riser, there being first and second laterally-spaced parallel slots in said riser, first and second guide screws threaded into the rear surface of said press block and laterally spaced the same as said first and second slots, each said screw having a flattened enlarged head freely passable in a first rotational position, through its respective slot, each head being turnable to a second rotational position to prevent retrograde passage through its slot, said screws in second position acting to guide said press block in translation, as aforesaid.

14. The utensil of claim 13, said first and second screws being threaded into the rear surface of said block, at and spaced along the top edge thereof, in parallel relation and at an upwardly-inclined acut angle with respect to the top surface of said block.

15. The utensil of claim 8, a heavy rectangular metal frame adapted to slide into position over and contacting said base plate contiguous to the passes of the ribbon thereof, a second metal ribbon, means attaching said second ribbon to and within said frame to form a second plurality of sapced parallel passes thereacross and spaced like the passes of said base plate, and means fixed with said frame and engageable with said base plate to positively locate said frame with each pass of its ribbon in a plane about mid way between the respective planes of a contiguous pair of passes of the ribbon of said base plate.

16. The utensil of claim 15, said frame in a second rotational position being slidable onto, over and in contact with said base plate, with the passes of its ribbon disposed normally to those of said base plate, and means positively locating and holding said frame in its second said rotational position.

17. The utensil of claim 16, said last-named means comprising an extension plate fixed at and extending along the top surface of one side run of said frame, said extension plate having a protruding straight edge engageable with the rear wall of said receptacle, to thereby determine and limit said frame in second position.

18. The utensil of claim 16, first and second pluralities of bars each extending in aligned relation along and inside each respective side run of said frame, said second metal ribbon being threaded in successive passes across said frame and through slots in said bars, and screw means connecting each bar to its respective side run of said frame and in spaced relation therewith, for decreasing the space therebetween in tensioning the passes of said second ribbon.

* * * * *